United States Patent [19]

Steers et al.

[11] Patent Number: 4,871,891

[45] Date of Patent: Oct. 3, 1989

[54] MICROWAVE OVEN PROVIDING DEFROSTING CONTROL

[75] Inventors: Michel Steers, La Queue-en-Brie; Jean-Pierre Hazan, Sucy-en-Brie; Gilles Delmas, Paris, all of France

[73] Assignee: U.S. Philips Corporation, New York, N.Y.

[21] Appl. No.: 202,160

[22] Filed: Jun. 2, 1988

[30] Foreign Application Priority Data

Jun. 2, 1987 [FR] France ..... 87 07684
Oct. 20, 1987 [FR] France ..... 87 14441

[51] Int. Cl.[4] ..... H05B 6/68

[52] U.S. Cl. ..... 219/10.55 B; 219/10.55 E; 374/149; 99/325

[58] Field of Search ..... 219/10.55 R, 10.55 B, 219/10.55 E, 10.55 F, 10.55 A, 10.55 D, 10.55 M, 494, 510; 374/149, 133, 135; 99/DIG. 14, 451, 325; 340/588, 589

[56] References Cited

U.S. PATENT DOCUMENTS 3,478,187 11/1969 Agdur et al. ..... 219/10.55 R
3,660,661 5/1972 Lachambre ..... 374/133 X
3,768,059 10/1973 Day ..... 374/133 X
4,038,105 7/1977 Brandeberry et al. ..... 374/135 X
4,341,937 7/1982 Staats ..... 219/10.55 M

FOREIGN PATENT DOCUMENTS 2571830 4/1986 France .

*Primary Examiner*—Philip H. Leung
*Attorney, Agent, or Firm*—Algy Tamoshunas; Leroy Eason

[57] ABSTRACT

A microwave oven which provides defrosting control for a frozen product to be defrosted. The oven comprises a microwave source and a detector arranged in the oven cavity in the proximity of the frozen product, the detector including a material which absorbs microwave energy, the absorption of microwave energy by the detector and by the frozen product causing their temperatures to rise and thereby defrosting such product. Variations in the detector temperature are measured by a measuring element which provides an electrical signal corresponding thereto. The detector is configured and insulated so as to have a heat exchange characteristic with its environment which results in its temperature detection sensitivity remaining constant during each of a plurality of successive defrosting operations of the oven. A computer control device evaluates when a defrosting operation has been completed by determining when the slope of the signal variation as a function of time remains the same at successive sampling instants.

13 Claims, 5 Drawing Sheets

MICROWAVE OVEN PROVIDING DEFROSTING CONTROL

BACKGROUND OF THE INVENTION

1. Field of the Invention

The invention relates to a microwave oven comprising a microwave source and a detector arranged in the oven in the proximity of a product to be processed, the detector comprising a material which absorbs microwave energy, the absorption of microwave energy by the detector and by the product causing their temperatures to rise, the detector temperature bein measured by means of a measuring element.

2. Description of the Related Art

Currently microwave ovens are often used for defrosting and reheating foodstuffs which have been previously kept in a freezer. In general, this defrosting is effected empirically: the user determines the approximate weight of the food to be defrosted in order to derive an approximate operating time for the microwave oven. This results in more or less complete defrosting or even a beginning of cooking. It is also known from the literature that around 2.45 Ghz the microwave absorption of water, which is the principal consitiuent of most foodstuffs, differs, considerably depending on whether the water temperature is below or above 0° C. The ice below 0° C. is highly transparent to microwaves and the water at a temperature above 0° C. has a very strong microwave absorption. This effect is caused by variations of dielectric losses of water as a function of temperature. The French patent 2,571,830 describes a microwave oven provided with a standard load placed in the oven beside the food to be processed. The standard load absorbs microwave energy in accordance with a distribution which depends on the standard load and the load of food to be processed.

Thus, from the rise in temperature of the standard load it is possible to derive the quantity of food present in the oven and to automatically determine the cooking time. According to said patent the rate of heating of the standard load is substantially independent of the temperature of the detector.

However, the said patent does not reveal a detector construction which enables the detector to be used successively with a satisfactory and substantially constant detection sensitivity

SUMMARY OF THE INVENTION

This technical problem is solved by the present invention in that the detector comprises means enabling its heat exchange with the environment to be controlled, allowing the detector to be used during a plurality of successive defrosting operations with an optimum and substantially constant detection sensitivity to detect the end of each defrosting operation.

In a first embodiment the detector is insulated from its environment by a thermal insulator, which is transparent to microwaves, in order to reduce the heat exchange and to ensure that the temperature reached by the detector material at the end of the defrosting operation exhibits an increase which is substantially the same during a plurality of successive defrosting operations.

In a microwave oven the temperature rise of a load as a function of time obeys a calorimetric-type relationship $$dT=P.dt/mc$$

where dT is the temperature variation during the time interval dt for a mass m of a body having a specific heat c, and P is the microwave power available in the oven.

Experiments conducted by the Applicant have shown that this relationship is also valid if said mass is divided into two masses $m_1$ and $m_2$ such that $m=m_1+m_2$. The relationship then becomes:

$$m_1dT_1+m_2dT_2=mdT \quad (1)$$

$dT_1$ and $dT_2$ then are the temperature rises of the two masses $m_1$ and $m_2$ and dT is the temperature rise of the mass m if it has been exposed to microwaves in the oven under the same conditions as the masses $m_1$ and $m_2$, in particular for the same heating period. This relationship is still valid when two masses of different specific heat are placed in the oven:

$$m_1c_1dT_1+m_2c_2dT_2=mcdT \quad 1$$

It follows from these relationships that if two loads are simultaneously placed in a microwave oven the total power available will be distributed between the two loads in such a way that the temperature of each load is raised by a value which is inversely proportional to its mass and to its heat capacity. Thus, if the thermodynamic characteristics of one of the loads are known, its temperature variation will depend on the presence and the thermodynamic state of the other load. The first load should have well-defined and stable thermodynamic parameters. It consitutes the detector.

However, the law represented by relationships (1) or (2) relates to substances for which the microwave absorption is the same. If this is not the case, the temperature rise of the substance of the mass $m_1$ and that of the substance of the mass $m_2$ will consequently change. In particular, if one of the substances is ice, the product to be defrosted, as in the situation envisaged by the invention, its absorption coefficient will be very small. Therefore the microwave energy will be absorbed mainly by the detector itself, which is constructed to have a suitable absorption coefficient. The transition of the state of the product from ice to water results in the product progressively absorbing more and more microwave energy, i.e. being heated increasingly. The energy absorbed by the detector decreases progressively. Thus, the variation of the detector temperature will enable the variation in temperature of the product being defrosted and placed in its proximity to be followed.

Since the product to be defrosted generally consists largely of ice the material of the defrosting detector should exhibit dielectric losses higher than those of ice.

The detector material may be liquid such as water, oil or a solid or it may be arranged on a carrier which is transparent to microwaves. The material of the carrier may be selected from the following materials: glass ceramics, aluminium, glass.

However, it is necessary that a plurality of successive defrosting operations can be carried out without the detection sensitivity for the defrosting process being significantly affected. A material which receives a certain amount of microwave energy exhibits a rise in temperature, but at the same time it will lose heat to the environment by heat exchange. If a plurality of successive defrosting operations are carried out the heat will accimulate but on account of thermal losses a thermal equilibrium will be established between the detector and its environment. Consequently, the temperature variations of the detector become increasingly smaller (assuming that all the other parameters remain the same) as the number of defrosting operations increases. In order to ensure a substantially constant detection sensitivity it is therefore necessary, in accordance with the first embodiment of the invention, to thermally insulate the detector material in order to reduce the heat exchange with the environment. This thermal insulation is provided in order to enable a plurality of successive defrosting operations to be carried out without a deterioration of the detector sensitivity. It should allow the detector to resume a temperature of equilibrium with the environment after a long period.

In a second embodiment, however, the detector will rapidly resume its neutral temperature once the temperature-rising stage is terminated enabling it to be reused rapidly. For this purpose, such embodiment of the detector has a large area of heat exchange with the environment and a small thickness in order to promote the exchange of heat and to ensure that the detector has a small thermal lag, so that it can rapidly resume its initial characteristics after each defrosting cycle. Such an embodiment of the detector may have crenellated shape.

The rise in temperature of the detector will depend on the state of the product to be defrosted. In particular, if the product which by nature contains much water, is taken from the freezer at a temperature of approximately −20° C., its microwave absorption will be very low. Consequently, all the power available in the microwave oven will be utilised to raise the temperature of the detector. As soon as the process of defrosting the product sets in, the product will absorb more and more microwave power and consequently the temperature of the detector will rise less rapidly. The slope of the curve representing the temperature rise of the detector as a function of time will therefore decrease constantly until all the ice present in the product to be defrosted has been transformed completely to water. Consequently, in accordance with the calorimetric law governing the temperature rise in a microwave oven as a function of time, the temperature rise of the product will be substantially linear function of time if the thermodynamic characteristics of the product do not vary.

In order to determine the variations in slope of the temperature rise of the detector the temperature-variation measuring element supplies an electric signal whose variations in slope as a function of time are determined by means of a computing and control device. The detection sensitivity is maintained substantially constant when a plurality of successive defrosting operations are carried out. Said variations are processed by the computing and control device, which compares the slope of said variations as a function of time at successive instants and acts to control the operating cycle of the microwave source when two successive values of said slope are substantailly equal.

The presence of the detector makes the power selection switch of the oven redundant. Indeed, at the beginning it is adequate to operate the oven with a low microwave power repetition rate and to measure the slope of the curve representing the temperature rise of the detector as a function of time. If this slope decreases the product in the oven is being defrosted becomes only said slope becomes only moderate the oven can automatically increase its microwave repetition rate because that the means that the product in the oven is already defrosted and merely has to be reheated.

The criterion to stop the defrosting function should allow for the fact that if the product to be defrosted consists substantially of ice the slope of the curve representing the variations in temperature of the detector as a function of time may remain constant and thus resemble that of a product already defrosted. The distinction is then made by means of the value of said slope:

if it is substantially equal to the slope of the temperature rise the detector alone, the product in the oven is frozen, if it is substantially smaller than such slope, that means that the product in the oven is consequently defrosted.

When a very high detection sensitivity is required at the beginning of the defrosting cycle it is possible to use a liquid substance, for example oil, whose heat capacity and/or microwave absorption decrease very strongly with the temperature. If the product is then still frozen the temperature of the liquid will rise very rapidly and as soon as defrosting begins a very distinct plateau will occur in the curve representing the detector temperature as a function of time. This effect is caused by the very strong decrease of the product mcdT of the detector. It may also be considered to use a plurality of detectors having different thermodynamic characteristics.

BRIEF DESCRIPTION OF THE DRAWINGS

Embodiments of the invention will now be described in more detail, by way of non-limitative example with reference to the accompanying drawings in which:

In FIG. 1*a* the curve 10 represents the temperature variations of a detector consituted by a mass $m_1$ of 100 grammes of water and the curve 11 represents the temperature variations of a product consisting of a mass $m_2$ of water, both placed in a microwave oven for temperatures above the ambient temperature and for a length of time which depends on the mass $m_2$. The temperature rise of the two masses decreases as the mass $m_2$ increases. The rise in temperature of the mass $m_1$ of the detector is greater than that of the larger mass $m_2$.

Figure 1A:
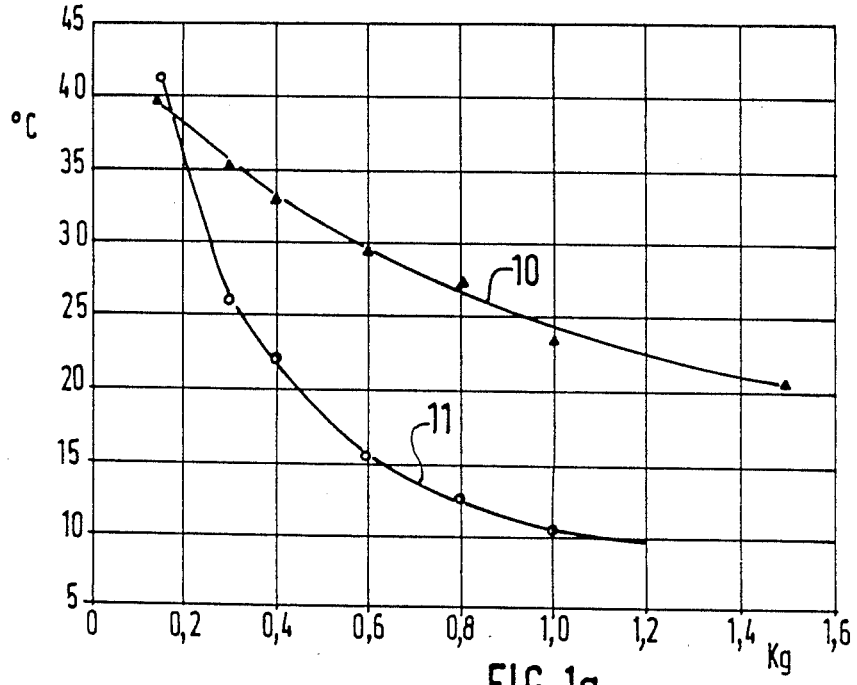
FIG. 1*a* shows temperature variation curves of a detector having a mass $m_1 = 100$ grammes and a product having a mass $m_2$, both consisting of water in the liquid state, as a function of the mass $m_2$.
Figure 1B:
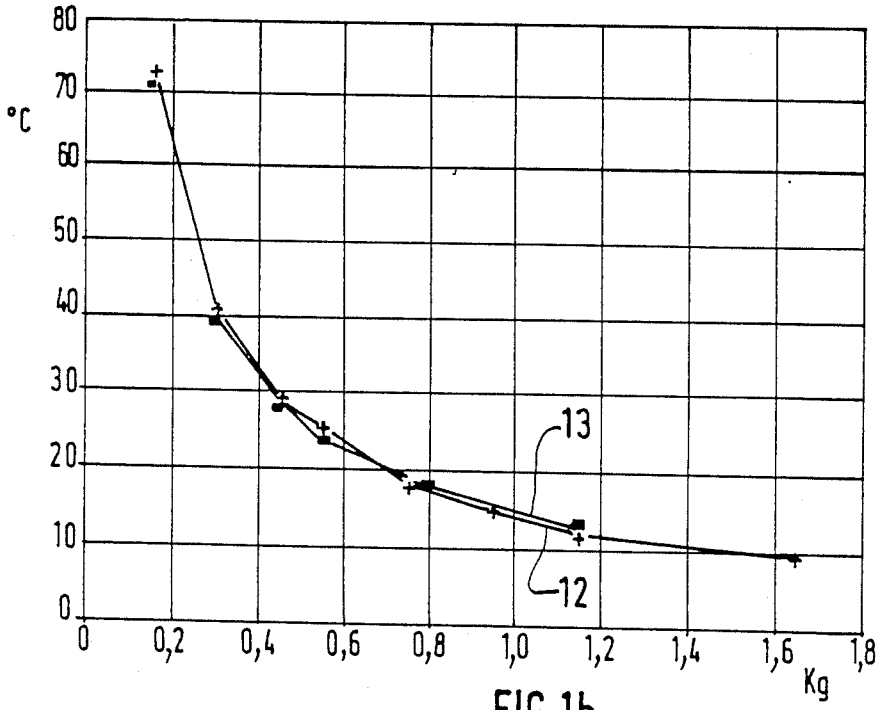
FIG. 1*b* shows curves illustrating the agreement between the results of experimental temperature measurements carried out on a mass $m_1 + m_2$ and those computed by means of equation 1.

The curve 12 in FIG. 1*b* represents the temperature variations of a mass of $m_1+m_2$ grammes of water. The curve 13 is formed by points obtained by computing the temperature rise of a mass of $m_1+m_2$ grammes of water by means of equation 1. It is found that the two curves coincide. This demonstrates that the microwave energy dissipated in the form of heat is distributed in the two loads in such a way that their temperatures rise in inverse proportion to mass and specific heat of each load. The temperature rise of the detector thus enables the temperature rise of the product situated in its proximity to be detected and in particular the defrosting cycles to be monitored.

Figure 2A:
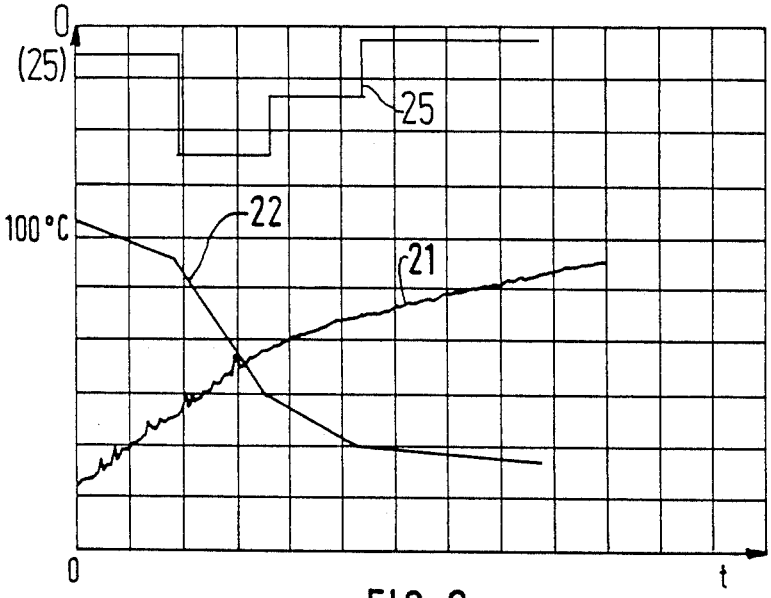
FIG. 2*a* shows curves representing the temperature and temperature variations, as a function of time for a detector consisting of water, arranged beside a product to be defrosted and consisting of a mass of ice during defrosting the mass of ice.

FIG. 2*a* represents the temperature variations 21 as a function of time for a detector consisting of water during defrosting of a mass 200 grammes of ice. The slope of the curve 21 is represented by the curve 22. It is found that at the beginning said slope has a large value which initially decreases slowly and subsequently rather rapidly until it finally stabilises. This stabilisation is utililsed in order to detect the end of the defrosting cycle by means of the computing and control device.

The second derivative 25, represented by straight lines, initially increases and subsequently decreases in absolute value during the defrosting cycle. When this cycle is completed the second derivative has a small value. When this value becomes smaller than a predetermined value the computing and control device may act to set the oven to an other mode of operation: cooking, slow reheating, off, etc. . . .

Figure 2B:
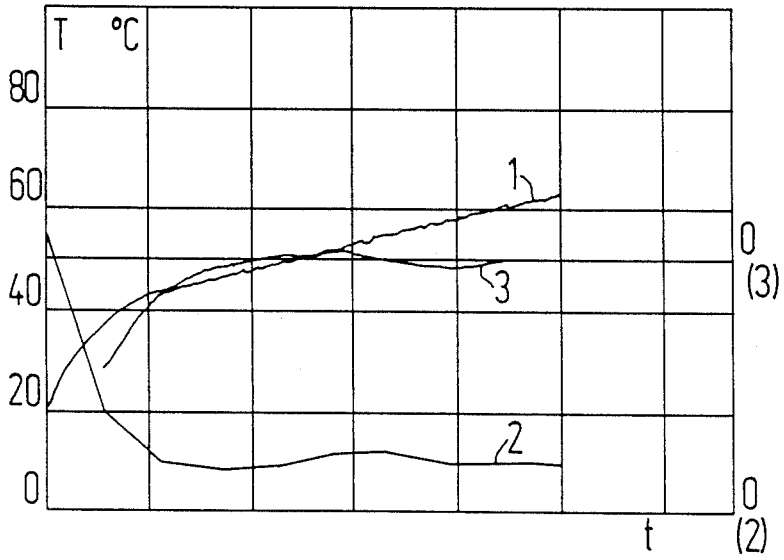
FIG. 2*b* shows the same curves representing the temperature and the temperature variations for the same detector arranged beside the defrosted product during reheating to a temperature above the melting temperature of ice.

FIG. 2*b* shows a curve similar to that in FIG. 2*a*. The first and second derivatives are determined by means of a more accurate computing process. The curve 1 represents the temperature variation of the detector. The curve 2 represents the first derivative of the curve 1. The curve 3 represents the second derivative of the curve 1. The zero level for the curves 2 and 3 are indicated in the right hand part.

Figure 3A:
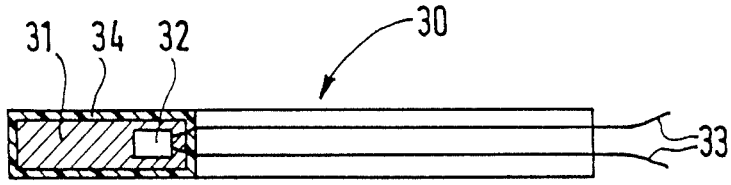
FIG. 3*a* and FIG. 3*b* diagrammatically show two insulated detectors in the first embodiment.
Figure 3B:
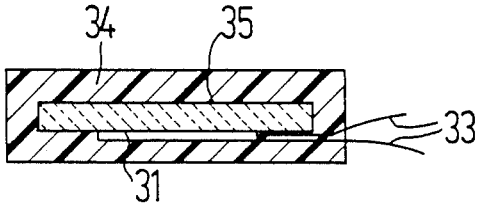
Figure 3C:
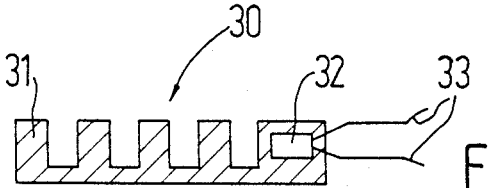
FIG. 3*c* diagrammatically shows a non-insulated detector in the second embodiment.

FIGS. 3*a*, 3*b* and 3*c* show three non-limitative examples of defrosting detectors 30.

FIG. 3*a* shows a substance 31 which can absorb microwaves, the substance being in contact with an element 32 for measuring its temperature. This element may be a thermocouple, a thermistor or any other temperature measuring element. The element is connected to external circuitry by leads 33. The substance 31 may be a liquid or a solid. It is contained in a vessel or receptacle 34 to provide thermal insulation from its environment.

The liquid substance may be water, oil or any other liquid having dielectric losses such that a satisfactory heating of the detector is ensured.

The solid substance may be ferrite, a solid containing metal ions, or any other solid having dielectric losses such that a satisfactory heating of the detector is ensured.

FIG. 3*b* shows another embodiment of the invention. The material 31 is attached to a substrate 35 which hardly or not absorbs microwaves. The substrate 35 and the material 31 are thermally insulated by an insulator 34. The latter may also constitute the vessel. Preferably, the material 31 is applied by silk-screening. It may be an ink, for example a resistive ink, intended for constructing thick-film circuits. The substrate is for example a glass-ceramic plate. The thermal insulator 34 is selected from the following materials: polystyrene, polyimide, epoxy, silicone, formaldehyde, polyisopropene, epoxy resin, or any other thermally insulating plastics material which is transparent to microwaves.

The element for measuring the temperature variatians may comprise a shielded probe of a type known in the field of microwave ovens, whose leads 33 are shown in FIG. 3*b*.

Most of the resistive inks have a temperature variation coefficient adequate for use as measuring element. The detector shown in FIG. 3*b* is therefore very compact. The leads 33 must be shielded at the location where they can be exposed to microwave energy. Inside the vessel 34 they can be formed by means of an ink having a substantially higher resistance than the substance 31.

In this case the applied ink enables an electrical resistance to be obtained which varies as a function of the temperature and thus constitutes both the measuring element detecting the temperature variations and the medium absorbing microwaves.

FIG. 3*c* shows a type which is crenellated in order to enlarge the area of the substance 31 which is exposed to its direct environment. This may apply to the solid substance, or to the liquid substance via a vessel of a good thermally conducting material. This enlarged area enables a rapid cooling of the material when the microwave heating operation is terminated and the detector 30 is to be re-used rapidly. Other shapes may be selected in order to obtain a large exposure area.

Figure 4A:
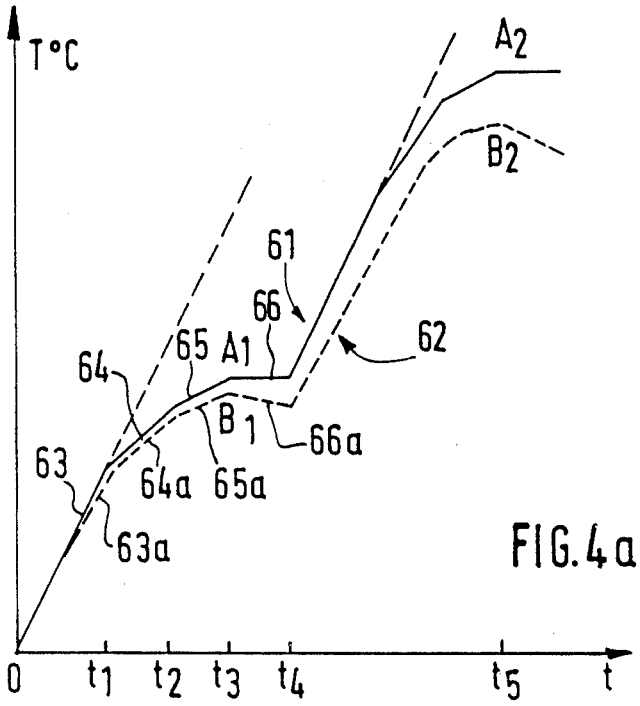
FIG. 4*a* and FIG. 4*b* illustrate the temperature rise for an insulated detector and a non-insulated detector during a plurality of successive defrosting operations.

FIG. 4*a* shows the temperature variationas for an insulated detector 61 and for a non-insulated detector 62 during a plurality of successive defrosting opertions. FIG. 4*a* shows two successive operations. The first defrosting operation is effected between the instants 0 and $t_3$ and the second between the instants $t_4$ and $t_5$. The first operation comprises a plurality of stages, which are represented as straight lines for the clarity of FIG. 4*a*.

The following stages occur:

from 0 to $T_1$ the still frozen product is reheated (line 63).

from the $t_1$ to $t_2$ the product to be defrosted is being defrosted (line 64). The detector is heated less rapidly.

from $t_2$ to $t_3$ the product to be defrosted is still being defrosted. It absorbs microwave energy; the detector is heated less rapidly.

from $t_3$ to $t_4$ the actual defrosting operation is completed and the detector resumes a certain temperature of equilibrium depending on its thermal insulation (line 66).

The curve represented by the lines 63, 64, 65, 66 relates to a thermally insulated detector. For a detector having a less effective thermal insulation the corresponding curve is represented by the lines 63*a*, 64*a*, 65*a*, 66*a* corresponding to the same stages. In particular the line 66*a* shows that the temperature of the detector decreases when the actual defrosting stage is terminated.

For insulated and slightly insulated detectors the maximum temperatures which are reached occur at points $A_1$ and $B_1$ respectively. When two defrosting operations are preformed one after the other, the first between the instants 0 and $t_3$ and the second between the instants $t_4$ and $t_5$, the maximum temperatures which are reached occur at $A_2$ and $B_2$ for the insulated detector and the slightly detector respectively. The temperature corresponding to point $B_2$ is lower than that corresponding to point $A_2$. The temperature rise is inadequate. This effect increases as the number n of successive defrosting operations increases.

Figure 4B:
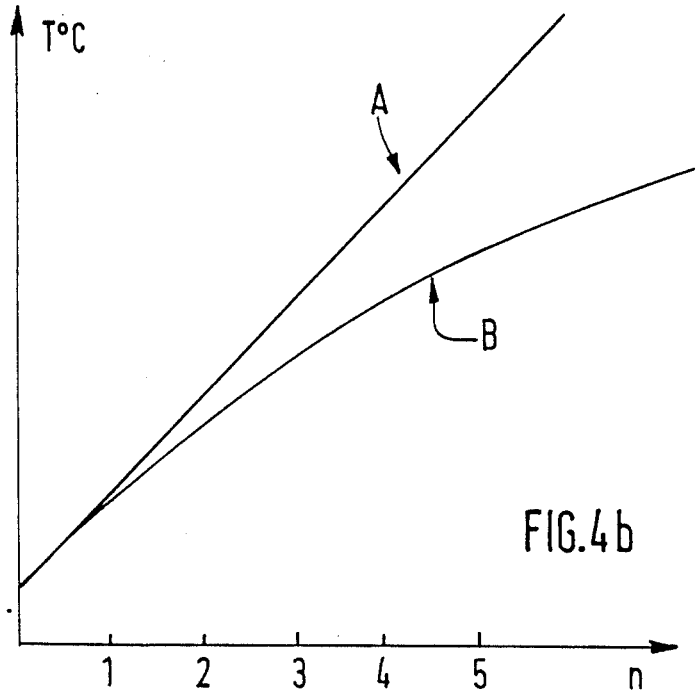

Said effect is illustrated in FIG. 4*b*. A substantially rectilinear first curve A represents the variations corresponding to points of type A in FIG. 4*a*. The second curve B represents the variations for points of type B. The curve B relates to a slightly insulated detector. This curve B has a curvature, which indicates that the detection sensitivity will decrease when a plurality n of successive defrosting operations are carried out. The curve A relates to an insulated detector and the asymptotic effect will not occur if the number of defrosting operations is not too large. The sensitivity with which the temperature variations are detected during defrosting of the product thus increases when the detector is sufficiently insulated for a reasonable number of successive defrosting operations. In this way this detection sensitivity remains substantially constant after a plurality of successive defrosting operations.

Figure 5A:
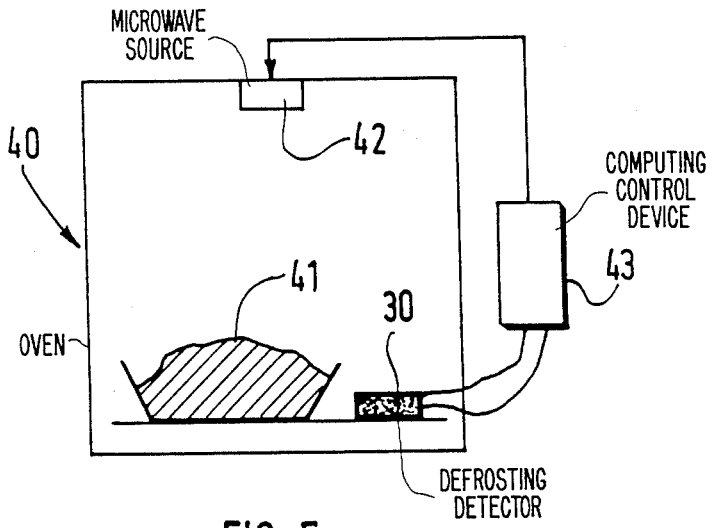
FIG. 5*a* and FIG. 5*b* diagrammetically show two microwave ovens employing different detectors.

FIG. 5*a* shows a microwave oven 40 equipped with a defrosting detector 30 in accordance with the invention. The detector is placed beside the product 41 to be defrosted. A microwave source 42 emits microwaves to which the product 41 and the detector 30 are exposed. The results of the measurement of the temperature of the detector 30 is transmitted to a computing control device 43, which acts to change the operation of the microwave source.

Figure 5B:
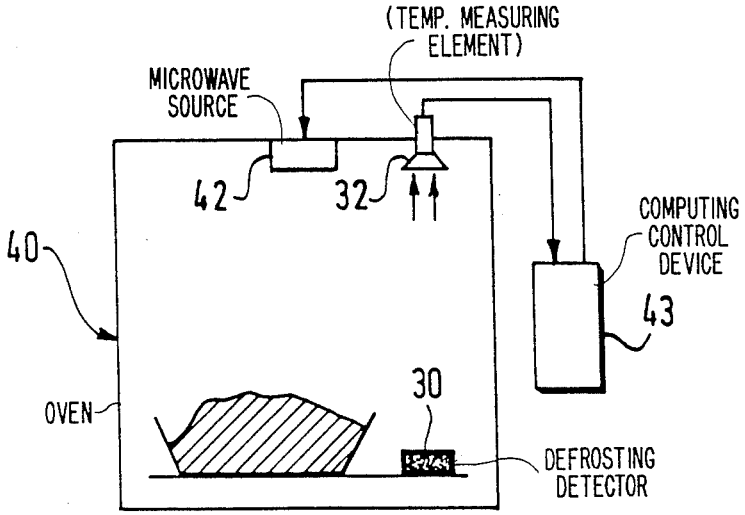

FIG. 5*b* shows another microwave oven in which the defrosting detector 30 is separated from the temperature measuring element 32. Said element comprises an infrared radiation detector of the pyroelectric type. In this way the temperature of detector 30 is determined by a remote measurement. The measurement signal is transferred to the computing control device 43 which influences the microwave source 42.

Figure 6:
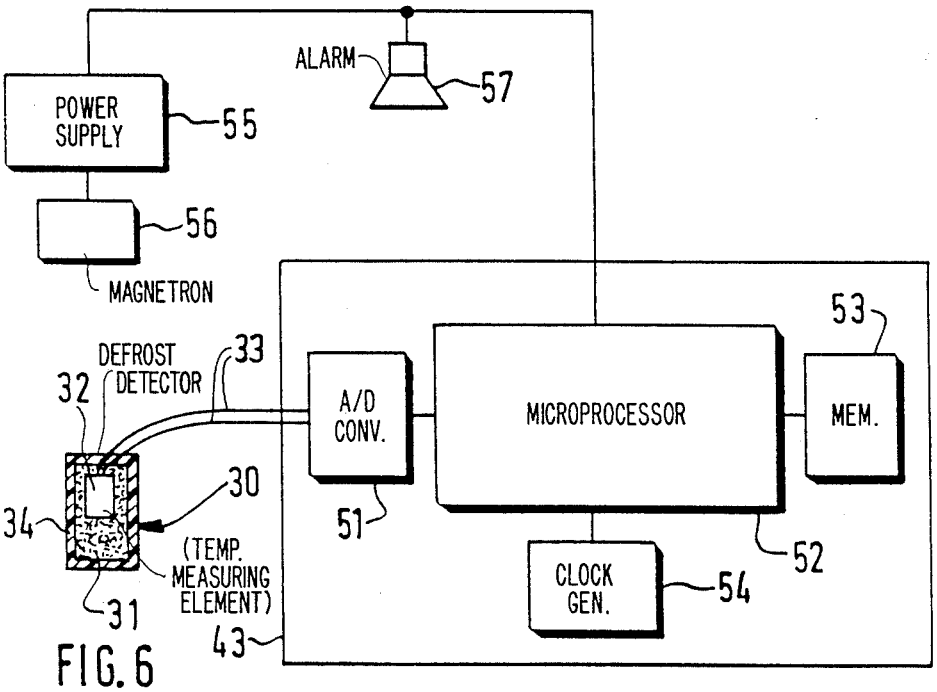
FIG. 6 shows an electric circuit arrangement for controlling the operation of the microwave source in response to measurements effected by means of the detectors.

FIG. 6 shows an electric circuit arrangement for controlling the operation of the microwave source in response to the measurements effected by means of the detector. The electric signals from the detector 30 are applied to the computing control device 43. An example of said device comprises an A/D converter 51 connected to a microprocessor 52 with a memory 53 and a clock generator 54. The microprocessor 52 determines the variations in slope of the electric signal which it receives and stores the values in the memory 53. The value at the instant t is compared with that determined at the instant t−1 and, if the two consecutive values are substantially equal, the microprocessor influences the power supply 55 of the magnetron 56 constituting the microwave source. An alarm 57 can indicate the progress of the operations.

The operating principle is as follows. The temperature of the detector is converted into an electric signal, which is converted into a digital signal by means of an analog-to-digital converter. This signal is subsequently stored in a RAM and processed by the microprocessor. In the case of defrosting processing consist of measuring the temperature at fixed time intervals and comparing the different measurement values with each other in order to determine a slope of the curve representing the rise in temperature of the detector as a function of time, and subsequently determining the variation of said slope. For example, during a complete defrosting cycle a temperature measurement may be carried out every two seconds and the rate at which the temperature rises may be measured after every 100 temperature measurements by a method such as the least-squares method. Such a measurement then yields a variation in slope as a function of time whose characteristics may be as follows in the case of a body containing a large amount of water.

Initially the load is frozen. The rise in temperature of the detector is rapid and follows a curve which would be identical if the detector alone were present. Under these conditions the slope measured by the least-squares method is substantially a straight line substantially parallel to the time axis.

Subsequently the load begins to defrost. The rise in temperature of the detector is less rapid. The curve of the slope as a function of time then has a negative derivative.

When the load is defrosted completely the rise in temperature of the detector becomes again monotonic with a more moderate slope than at the beginning of the operation when no change of phase occurs, such as boiling. In the least-squares curve this effect manifests itself as a stabilisation of the curve which stabilised portion extends parallel to the time axis. The microprocessor recognises this new stabilisation as the end of the defrosting cycle. By means of suitable input/output interfaces the microprocessor can then turn off the microwave source, and if desired, provide an indication to the user or start a reheating cycle.

The microwave oven is now again ready for further defrosting operations with the same detection sensitivity to temperature variations.

What is claimed is:

1. A microwave oven which provides controlled defrosting of frozen products, comprising a microwave source and a detector arranged in the oven cavity in the proximity of a given frozen product to be defrosted, the detector including a material which absorbs microwave energy, the absorption of microwave energy by the detector and by the given product causing their temperatures to rise so as to defrost said product, variations in the detector temperature being measured by a measuring element producing an electrical signal which varies in accordance with such temperature variations; characterized in that:

said oven comprises a computing and control device connected to said temperature measuring element for determining from the variations of said electrical signal with time when defrosting of the given product has been completed; and said detector has a heat exchange characteristic with its environment such that the temperature rise thereof during defrosting of said given product is substantially the same as the temperature rise thereof during defrosting of each of a plurality of frozen products successively individually placed in said oven for defrosting.

2. A microwave oven as claimed in claim 1, characterized in that said detector comprises a thermal insulator which thermally insulates said microwave absorbent material from its environment, said thermal insulator being transparent to microwaves and sufficiently reducing the heat exchange characteristic of said microwave absorbent material so that the temperature rise thereof during defrosting of said given product is substantially the same as the temperature rise thereof during defrosting of each of said successively defrosted frozen products.

3. A microwave oven as claimed in claim 2, characterized in that the thermal insulator is selected from the following materials: polystyrene, polyimide, epoxy, silicone, formaldehyde, polyisopropene, epoxy resin or any other thermally insulating plastics material which is transparent to microwaves.

4. A microwave oven as claimed in claim 1, characterized in that said detector has a large area in relation to the thickness thereof so as to achieve increased heat exchange between said absorbent material and its environment, whereby said absorbent material will resume its initial temperature more rapidly following defrosting of each of said frozen products.

5. A microwave oven as claimed in claim 4, characterized in that the detector has a crenellated shape.

6. A microwave oven as claimed in claim 1, characterized in that the microwave absorbing material is a solid.

7. A microwave oven as claimed in claim 6, characterized in that the absorbing material is deposited on a carrier which is transparent to microwaves.

8. A microwave oven as claimed in claim 7, characterized in that the material of the carrier is selected from the following materials: glass ceramics, aluminium, glass.

9. A microwave oven as claimed in claim 7 or 8, characterized in that the microwave absorbing material is an ink deposited by silk-screening.

10. A microwave oven as claimed in claim 9, characteized in that the ink is a resistive ink.

11. A microwave oven as claimed in claim 10, characterized in that the applied ink provides an electrical resistance which varies as a function of temperature and which thus constitutes both the measuring element for determining the temperature variation and the microwave absorbing material.

12. A microwave oven as claimed in claim 1, characterized in that the microwave absorbing material is a liquid.

13. A microwave oven as claimed in claim 1, characterized in that the computing control device compares the slope of the variations of said signal as function of time at successive instants, and controls operation of the microwave source when said slope remains substantially the same at such instants.

* * * * *